US006881091B2

(12) United States Patent
Brandl et al.

(10) Patent No.: US 6,881,091 B2
(45) Date of Patent: Apr. 19, 2005

(54) ELECTRICAL UNIT WITH A CONNECTOR FOR A LOOP THROUGH CONDUCTOR

(75) Inventors: Wolfgang Brandl, Amberg (DE); Peter Donhauser, Amberg (DE); Alfred Fischer, Schwandorf (DE); Ludwig Niebler, Laaber (DE)

(73) Assignee: Siemens Aktiengesellschaft, Munich (DE)

( * ) Notice: Subject to any disclaimer, the term of this patent is extended or adjusted under 35 U.S.C. 154(b) by 5 days.

(21) Appl. No.: 10/344,762

(22) PCT Filed: Aug. 3, 2001

(86) PCT No.: PCT/DE01/02973

§ 371 (c)(1),
(2), (4) Date: Feb. 14, 2003

(87) PCT Pub. No.: WO02/15336

PCT Pub. Date: Feb. 21, 2002

(65) Prior Publication Data

US 2003/0176117 A1 Sep. 18, 2003

(30) Foreign Application Priority Data

Aug. 16, 2000 (DE) ..... 100 39 961

(51) Int. Cl.[7] ..... H01R 4/24
(52) U.S. Cl. ..... 439/417
(58) Field of Search ..... 439/400, 406, 439/409, 417

(56) References Cited

U.S. PATENT DOCUMENTS 4,062,616 A 12/1977 Shaffer et al.
4,950,169 A 8/1990 Martin et al.
4,969,839 A 11/1990 Nilsson
5,009,612 A * 4/1991 Rishworth et al. ..... 439/417
5,277,616 A 1/1994 Harting et al.
5,785,548 A * 7/1998 Capper et al. ..... 439/409
6,120,315 A * 9/2000 Gaertner et al. ..... 439/417

FOREIGN PATENT DOCUMENTS

| | | |
|---|---|---|
| DE | 2737328 | 12/1977 |
| DE | 4312781 | 1/1996 |
| DE | 19604222 | 8/1997 |
| DE | 29802674 | 5/1998 |
| FR | 2786611 | 6/2000 |

* cited by examiner

*Primary Examiner*—Renee Luebke
(74) *Attorney, Agent, or Firm*—Harness, Dickey & Pierce, P.L.C.

(57) ABSTRACT

The invention relates to an electrical unit comprising a mounting device for fastening the unit to a supporting element, e.g. to a mounting rail, and at least one insulation piercing connecting device provided with an insulation piercing element and with a holding element. The insulation piercing element and holding element can move in relation to one another. When the unit is fastened to the supporting element, a conductor can be inserted into the holding element. This enables aid conductor to be looped through the holding element. The conductor can be clamped by transferring the insulation piercing element and holding element into a closed position.

18 Claims, 4 Drawing Sheets

10
12
A
7
9
9
12
6
9
11
1

ELECTRICAL UNIT WITH A CONNECTOR FOR A LOOP THROUGH CONDUCTOR

This application is the national phase under 35 U.S.C. §371 of PCT International Application No. PCT/DE01/02973 which has an International filing date of Aug. 3, 2001, which designated the United States of America and which claims priority on German Patent Application number DE 100 39 961.4 filed Aug. 16, 2000, the entire contents of which are hereby incorporated herein by reference.

FIELD OF THE INVENTION

The present invention generally relates to an electrical device with a mounting device for fastening the device to a supporting element, such as a mounting rail.

BACKGROUND OF THE INVENTION

Units of this kind are known, e.g., in the form of contractors, relays, circuit breakers, field bus devices and many others.

Furthermore, so-called insulation displacement terminals are generally known, by way of which conductors can be clamped without previously removing the conductor insulation.

A typical disadvantage of insulation displacement terminals is that they are relatively large and can accept only one single conductor end or two conductor ends. Therefore, when electrical units are provided with either be dispensed with or a relatively large physical volume must be accepted, as two—already relatively large in their own right—insulation displacement terminal devices may be necessary, namely one each for feeding in and feeding out the wiring. For this reason, the majority of electrical units may be fitted with comparatively compact screw or spring (cage clamp) terminals.

A cable connector for a ribbon cable is disclosed in U.S. Pat. No. 4,062,616, which has an insulation displacement terminal device, the insulation displacement terminal device having a large number of insulation displacement terminals and a holding element. The insulation displacement terminals and the holding element can move in relation to one another. A ribbon cable can be inserted into the insulation displacement terminal device in a relative open position of insulation displacement terminals and holding element and can be clamped by moving it to a closed position. The ribbon cable can be looped through the holding element.

A cable connector for electronic devices is disclosed in U.S. Pat. No. 4,950,169, which internally has an electrical circuit by way of which the pin configuration is determined. With this cable connector, the conductors are connected to the circuit by way of screw connections.

An electrical power connector is disclosed in U.S. Pat. No. 4,969,839. This connector has an insulation displacement terminal device, which has several insulation displacement terminals and a common holding element. The insulation displacement terminals and the holding element can move in relation to one another. Conductors inserted into the holding element can be clamped by relative movement of holding element and insulation displacement terminals. The holding element has laterally open insertion slots for the conductors.

A plug connector for electrical conductors is disclosed in EP 0 921 592 A2. This plug connector has an insulation displacement terminal device with an insulation displacement terminal and a holding element. The insulation displacement terminal and the holding element can move in relation to one another. A conductor can be inserted in a relative open position of the insulation displacement terminal and holding element and can be clamped by moving it to a closed position. The conductor can be looped through the holding element. For this purpose, the holding element has a laterally open, straight, continuous insertion slot for the holder.

SUMMARY OF THE INVENTION

An embodiment of the present invention provides an electrical device with which, in spite of the use of insulation displacement technology, through-wiring may be achieved while taking up relatively little space. At the same time, the capability for the conductor to loop through the holding element should be achievable in a simple manner.

The indicated electrical device may have the following features:

a mounting device for fastening the device to a supporting element, e.g. to a mounting rail.

Moreover, the device has at least one insulation displacement terminal device with an insulation displacement terminal and a holding element.

The insulation displacement terminal and holding element are moveable in relation to one another.

When the device is fastened to the supporting element, a conductor can be inserted into the holding element in a relative open position of insulation displacement terminal and holding element and can be clamped by moving it to a closed position.

The holding element is designed in such a way that the conductor can be looped through the holding element.

The holding element has a laterally open, continuous insertion slot for the conductor.

The insertion slot has a curved section.

With the electrical device according to an embodiment of the present invention, a conductor, which is simultaneously the infeed and outfeed conductor, can therefore be clamped in a single insulation displacement terminal on the mounted electrical unit.

The construction of the electrical device is particularly simple if the insulation displacement terminal is arranged so as to be fixed in the electrical device and the holding element is a movable closing element in the electrical unit.

If the insertion slot also has a straight section and if a blind hole in line with the straight section branches off from the insertion slot, a cut-to-length conductor can also be clamped in a simple manner in the insulation displacement terminal device.

If the conductor has a conductor axis and if the insulation displacement terminal and the holding element execute a relative movement in a plane containing the conductor axis moving it from the open to the closed position, this results in a particularly simple design configuration of the electrical unit.

In principle, there can be any number of insulation displacement terminal devices. As a rule, however, the electrical device will have several insulation displacement terminal devices, which are arranged next to one another and/or opposite one another.

One electrical device with a mounting device, which requires several insulation displacement terminal devices, is, for example, an electromagnetic switching device, in particular a contactor.

Further scope of applicability of the present invention will become apparent from the detailed description given hereinafter. However, it should be understood that the detailed description and specific examples, while indicating preferred embodiments of the invention, arc given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
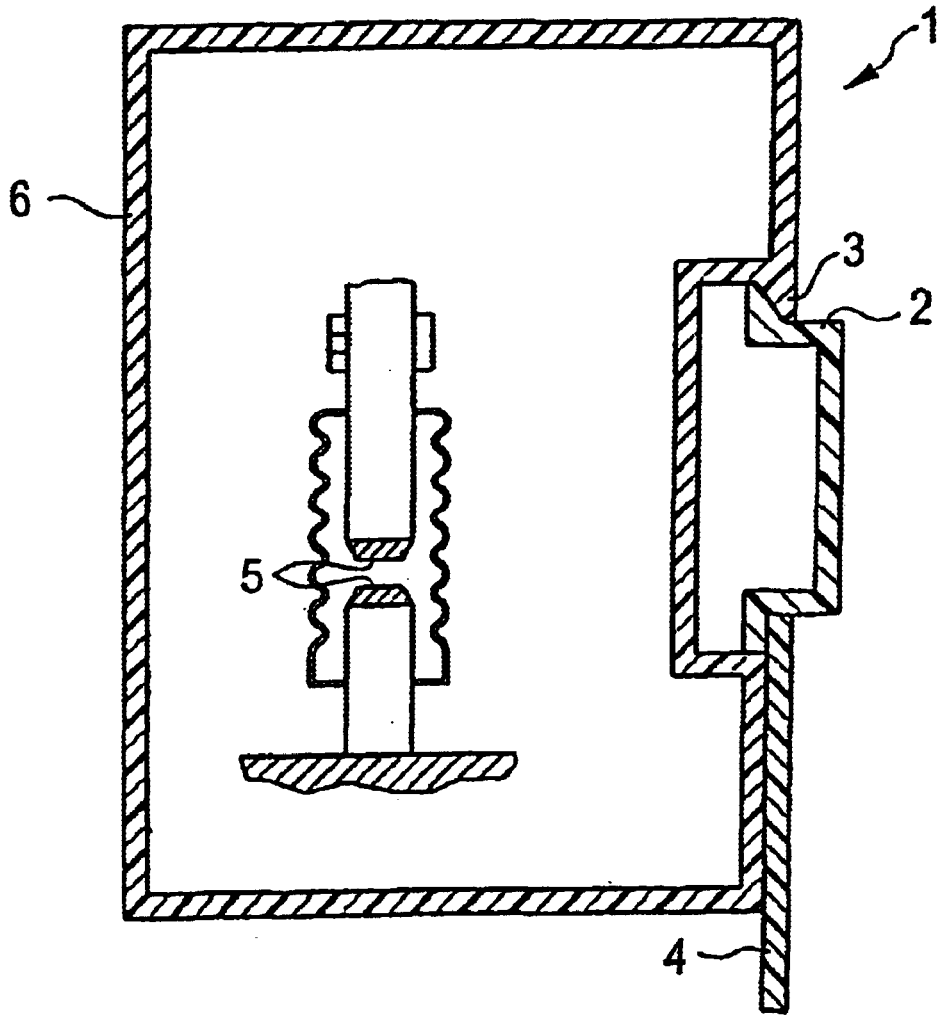
FIG. 1 shows a mounted electrical device from the side.

According to FIG. 1, a mounting face of an electrical device can be fastened by way of a mounting device 1 to a supporting element 2. According to FIG. 1, the supporting element 2 is a mounting rail. The mounting device includes a hook element 3 and a spring-loaded bolt 4 so that the electrical device can be snapped onto the mounting rail 2.

In principle, the electrical device can be of any nature. According to the exemplary embodiment, it is an electromagnetic switching device, e.g. as a contactor. This is indicated in FIG. 1 by a (vacuum) contact 5, shown symbolically.

Figure 2:
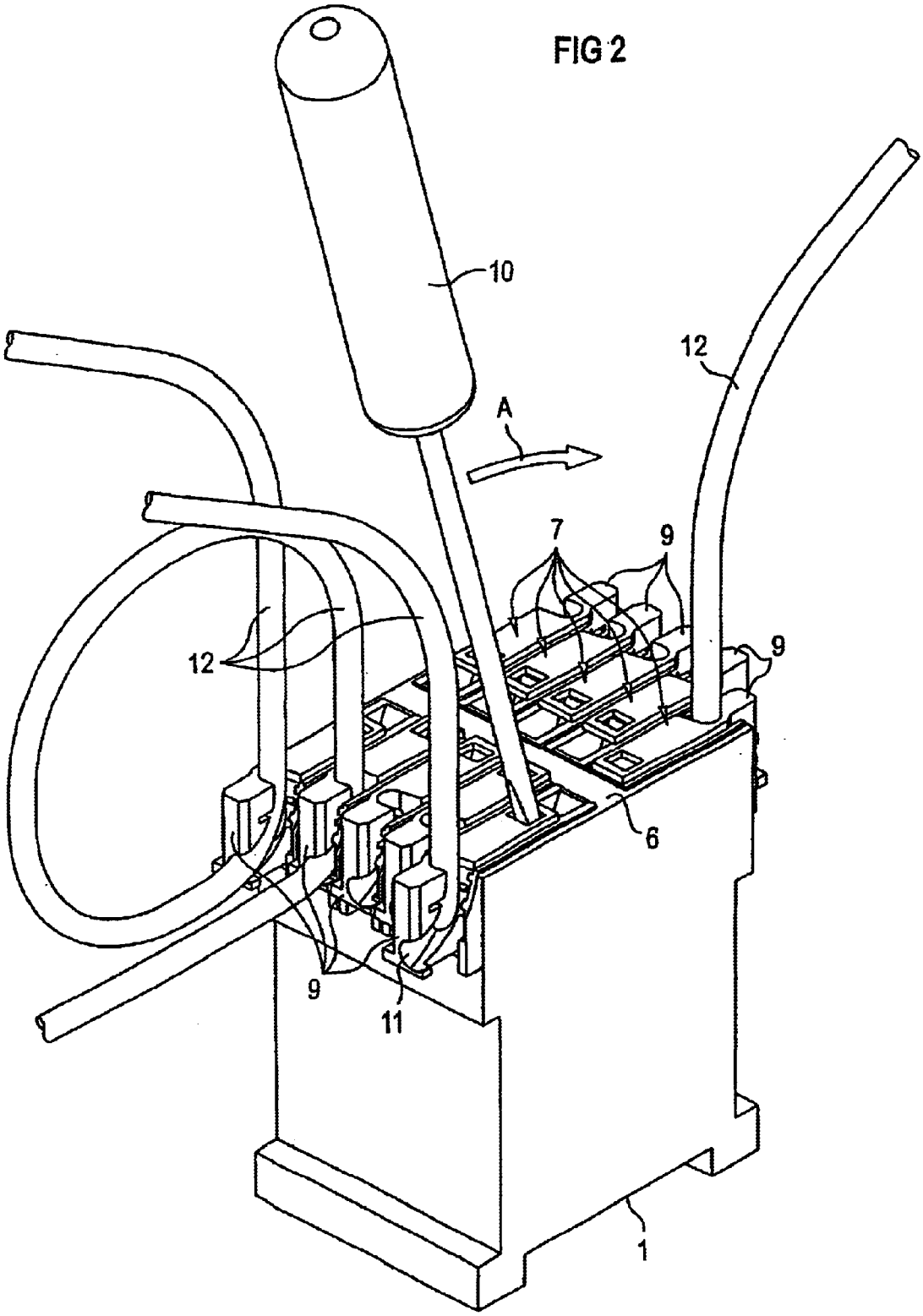
FIG. 2 shows the electrical device of FIG. 1 in perspective.

According to FIG. 2, two rows of insulation displacement terminal devices are arranged on a control face 6 opposite the mounting face. The insulation displacement terminal devices 7 are arranged next to one another within the rows, the rows themselves being arranged opposite one another. The insulation displacement terminal devices 7 are all designed to be the same as one another.

Only one of the insulation displacement terminal devices 7 is therefore described in more detail below in conjunction with FIG. 3.

Figure 3:
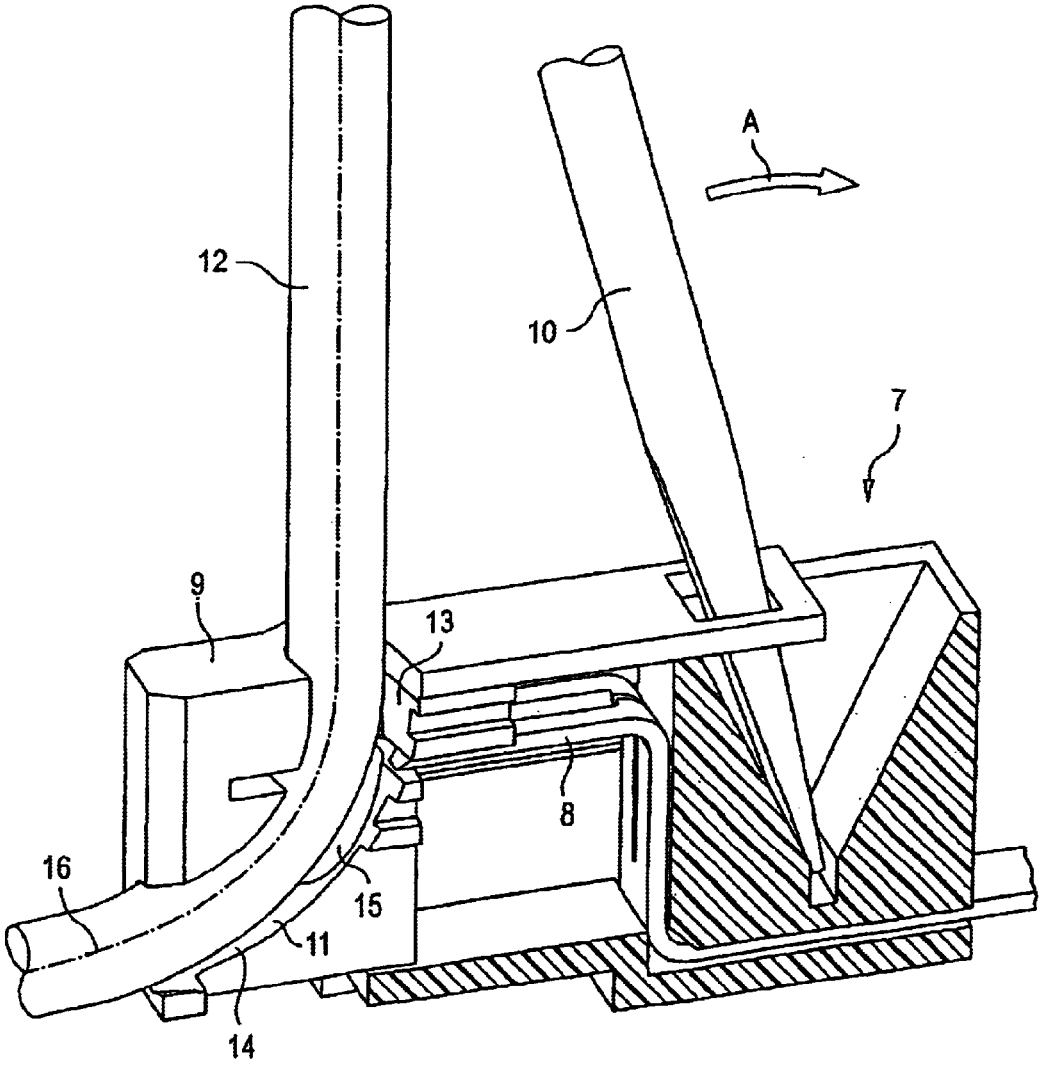
FIG. 3 shows an insulation displacement terminal device.

According to FIG. 3, each insulation displacement terminal device 7 may include an insulation displacement terminal 8 and a holding or closing element 9. According to FIG. 3, the insulation displacement terminal 8 is arranged so as to be fixed in the electrical device. The holding element 9, on the other hand, is movable in the electrical device. It is therefore a movable closing element 9. In principle, however, the holding element 9 could also be fixed and the insulation displacement terminal 8 could be movable.

The closing element 9 is movable in relation to the insulation displacement terminal 8 between an open position and a closed position. The open position is shown in FIG. 3. By pivoting a suitable operating tool 10, according to the exemplary embodiment a screwdriver 10, in the direction of an arrow A, the closing element 9 can be moved to the closed position. By pivoting the operating tool 10 back, the closing element 9 can be moved back to the open position.

Due to the arrangement of the insulation displacement terminal devices 7 on the control face 6, it is also possible to move the closing element 9 from the open position to the closed position and back again when an electrical device is fastened to the supporting element 2.

The closing element 9 has a laterally open, continuous insertion slot 11 for a conductor 12. When the closing element 9 is in the open position, the conductor 12 can be inserted in the insertion slot 11. The conductor 12 is then clamped by moving it to the closed position.

A single-core conductor 12 (solid or stranded) may be inserted into the closing element 9. However, two conductors 12 can also be inserted into the closing element 9.

Due to the characteristic that the insertion slot 11 is continuous, the conductor 12 can be looped through the closing element 9. It is also possible, on the one hand, to connect the conductor 12 to the electrical device and, on the other hand, to route the conductor 12 further to another connection. In this case, it is not necessary to cut the conductor 12 to length.

The insertion slot 11 has a straight section 13 and a curved section 14. As a result of this, a compact design of the electrical device can be achieved in spite of the capability of the conductor 12 to he looped through. Further, a blind hole 15, which is in line with the straight section 13, branches off from the insertion slot 11. It is therefore also possible, in a simple and reliable manner, to insert the cut-to-length conductor 12 into the straight section 13 and from there further into the blind hole 15 and thus to connect the conductor 12 to the electrical device without looping it further to an additional device.

The conductor 12 has a conductor axis 16 shown dotted in FIG. 3. The conductor axis 16 defines-namely in the case of straight routing of the conductor 12 at least one axis and, in the case of curved routing of the conductor 12, even defines a plane. The closing element 9 is likewise moved in a plane during the movement from the open to the closed plane. According to FIG. 3, the plane of movement of the closing element 9 and the plane defined by the conductor axis 16 coincide. However, the plane of movement contains at least the conductor axis 16.

Figure 4:
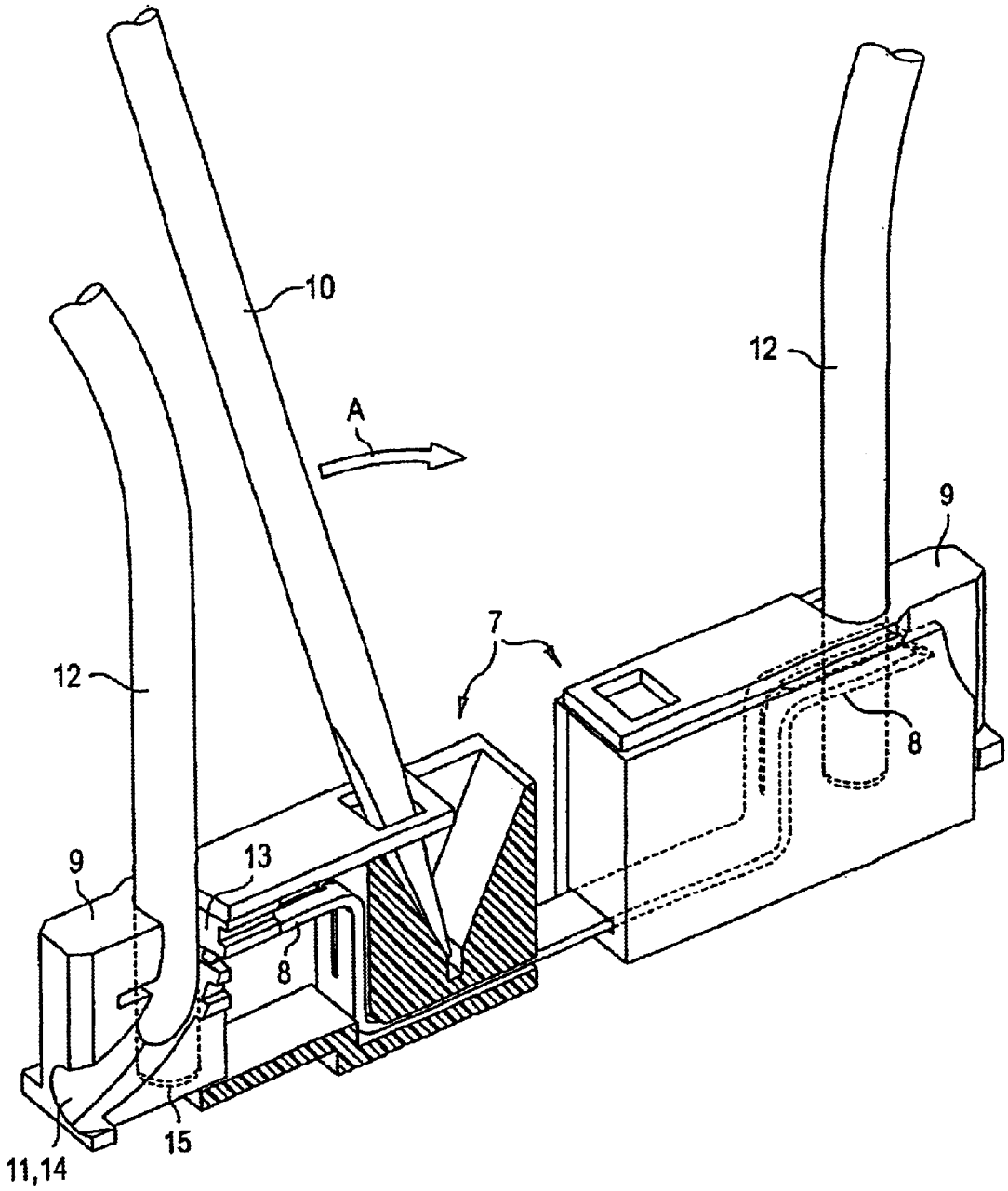
FIG. 4 shows a pair of insulation displacement terminal devices.

FIG. 4 shows two of the mutually opposing insulation displacement terminal devices 7 according to FIG. 2. With the double insulation displacement terminal device so formed, the two insulation displacement terminals 8 are connected directly together. A direct connection of this kind is practical, for example, for further connection of a ground potential in the case of contractors or other electromagnetic switching devices. Direct through-connection of this kind is also practical in the case of terminal strips.

According to FIG. 4, cut-to-length conductors 12 are inserted in the straight sections 13 of the insertion slots 11 and into the blind holes 15 in the two insulation displacement terminal devices 7. According to FIG. 4, only an electrical connection is therefore made from the one conductor 12 to the other conductor 12. In principle, however, it is also possible to loop through one or even both conductors 12 without cutting to length. It is therefore possible, for example, to feed one conductor to the left-hand of the two insulation displacement terminal devices 7 shown in FIG. 4 and from there further to an additional device and, at the same time, to create two feeds from the right-hand of the two insulation displacement terminal devices 7 shown to additional devices.

A large number of advantages can be achieved with the electrical device according to the invention. In this way, for example, only one termination point is required for making point-to-point connections. There is no need for any extra terminals for subsequent connection. It is also unnecessary to cut the looped-through conductor 12 to length. Furthermore, there is no voltage drop in the looped-through conductor due to contact resistances.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical device, comprising:

a mounting device for fastening the electrical device to a supporting element; and at least one insulation displacement terminal device with an insulation displacement terminal and a holding element, the insulation displacement terminal and the holding element being moveable in relation to one another, wherein when the electrical device is fastened to the supporting element, a conductor is insertable into the holding element in a relative open position of the insulation displacement terminal and the holding element, the conductor being clampable by transferring the holding element into a closed position relative to the insulation displacement terminal, and wherein the holding element includes a continuous insertion slot for receiving the conductor, the insertion slot having a lateral side that is open and a longitudinal axis that has a curved section.

2. The electrical device as claimed in claim 1, wherein the insulation displacement terminal is fixed in the electrical device, and the holding element is a closing element movable in the electrical device.

3. The electrical device as claimed in claim 2, wherein the longitudinal axis of the insertion slot further includes a straight section.

4. The electrical device as claimed in claim 2, wherein the conductor includes a conductor axis, the insulation displacement terminal and the holding element execute a relative movement in a plane containing the conductor aids as an open to closed position is performed.

5. The electrical device as claimed in claim 2, wherein the electrical device has at least one further insulation displacement terminal device.

6. The electrical device as claimed in claim 1, wherein the longitudinal axis of the insertion slot further includes a straight section.

7. The electrical device as claimed in claim 6, wherein the conductor includes a conductor axis, the insulation displacement terminal and the holding element execute a relative movement in a plane containing the conductor axis as an open to closed position is performed.

8. The electrical device as claimed in claim 6, wherein the electrical device has at least one further insulation displacement terminal device.

9. The electrical device as claimed in claim 6, wherein the holding element includes a blind hole in line with the straight section, the blind hole branching off from the insertion slot, the blind hole for receiving a cut-to-length conductor inserted along the straight section.

10. The electrical device as claimed in claim 9, wherein the insulation displacement terminal and the holding element execute a relative movement in a plane containing the longitudinal axis as an open to closed position is performed.

11. The electrical device as claimed in claim 9, wherein the electrical device has at least one further insulation displacement terminal device.

12. The electrical device as claimed in claim 1, wherein the insulation displacement terminal and the holding element execute a relative movement in a plane containing the longitudinal axis as an open to closed position is performed.

13. The electrical device as claimed in claim 12, wherein the electrical device has at least one further insulation displacement terminal device.

14. The electrical device as claimed in claim 13, wherein the insulation displacement terminal devices are arranged opposite one another.

15. The electrical device as claimed in claim 1, wherein the electrical device has at least one further insulation displacement terminal device.

16. The electrical device as claimed in claim 15, wherein the insulation displacement terminal devices are arranged next to one another.

17. The electrical device as claimed in claim 15, wherein the insulation displacement terminal devices are arranged opposite one another.

18. The electrical device as claimed in claim 1, wherein the electrical device is an electromagnetic switching device.

* * * * *